United States Patent [19]

Smith

[11] Patent Number: 4,773,556

[45] Date of Patent: Sep. 27, 1988

[54] AQUEOUS JOINT COMPOUND SEAL

[75] Inventor: Richard E. Smith, Williamsville, N.Y.

[73] Assignee: National Gypsum Company, Dallas, Tex.

[21] Appl. No.: 460,490

[22] Filed: Jan. 24, 1983

[51] Int. Cl.[4] ..... B65D 25/10; B65B 7/16

[52] U.S. Cl. ..... 220/93; 53/489; 426/397

[58] Field of Search ..... 220/93; 206/525; 53/489, 474, 488, 140; 426/397, 398, 124

[56] References Cited

U.S. PATENT DOCUMENTS

| | | | |
|---|---|---|---|
| 1,114,748 | 10/1914 | Graeber | 426/397 |
| 1,846,052 | 2/1932 | Grant | 426/398 |
| 2,465,755 | 3/1949 | Sanders | 206/425 |
| 2,609,119 | 9/1952 | Shilstone | 220/93 |
| 3,406,490 | 10/1968 | Mudd . | |
| 3,729,107 | 4/1973 | Present | 206/425 |
| 4,312,459 | 1/1982 | Leach | 220/93 |

*Primary Examiner*—George E. Lowrance

*Attorney, Agent, or Firm*—Robert F. Hause

[57] ABSTRACT

In a bucket, partially filled with an aqueous slurry of drywall joint compound, the joint compound is hermetically sealed from the air above by a formed-in-place flexible solid seal disposed over the entire top of the joint compound and preferably extending a short distance up the inner wall of the bucket. For partial use of the joint compound, the seal is first separated from the bucket inner wall and then lifted off the joint compound, cleaned, and kept in a condition suitable for reuse.

7 Claims, 1 Drawing Sheet

AQUEOUS JOINT COMPOUND SEAL

This invention relates to a novel seal for ready-mix joint compounds that are packaged in rigid containers, and particularly to a formed-in-place flexible cover disposed in immediate contact with and throughout the top of the joint compound in the container.

A common method of packaging ready-mix joint compounds is in five-gallon buckets or pails, with lids placed on the top of the bucket. Ready-mix joint compounds are cementitious materials which are admixed with water prior to being packaged and shipped. They are formulated to form a relatively rigid solid form when dried, particularly after being spread in a relatively thin layer over the joints of gypsum wallboards, in drywall construction.

In the common bucket, with a lid placed on the top, there is always a small amount of air in the bucket, between the top of the ready-mix joint compound and the lid. The presence of this air permits a certain small amount of drying and hardening of the ready-mix joint compound on the very top of the slurry in the bucket. This small amount, no matter how small, can be enough to affect the performance of the joint compound, if it is not removed prior to use of the joint compound.

Secondly, it is essential that the prior common bucket and lid require either that the lid be of a somewhat flexible material, capable of tightly sealing out air, or that a separate gasket be employed, or even greater amounts of slurry, at the top, will dry and harden and require removal and disposal, and thus waste material.

The present invention consists of the method of forming in place a flexible, substantially impermeable, inert seal on or throughout the top surface of the joint compound which forms a sealed quantity of ready-mix joint compound, preventing drying or hardening of material, under the seal, before desired on a wall. The invention also contemplates the use of part of the ready-mix joint compound in the bucket, followed by replacing the novel seal in contact with at least a major portion of the top surface of the remaining slurry, forming a novel partially used, sealed bucket of ready-mix joint compound which will suffer from very little or no drying and hardening, because of the lack of substantially any air contacting the top surface of the slurry.

It is an object of the present invention to provide a novel sealed bucket of ready-mix joint compound, and method of making the same.

It is a further object to provide a novel reusable ready-mix joint compound and container combination and the method of providing the same.

These and other objects and advantages of the invention will be more readily apparent when considered in relation to the preferred embodiments as set forth in the specification and shown in the drawings in which.

Figure 1:
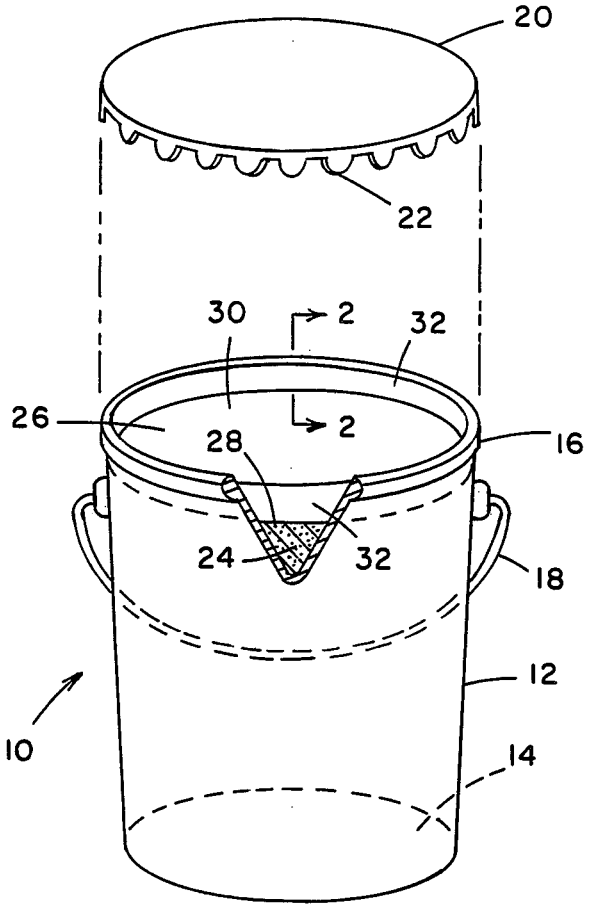
FIG. 1 is an isometric view of a newly sealed bucket of ready-mix joint compound, with the lid removed, in accordance with the invention.
Figure 2:
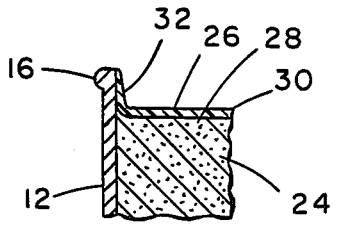
FIG. 2 is a vertical sectional view of the top edge of the sealed bucket of FIG. 1 taken on line 2—2 thereof.
Figure 3:
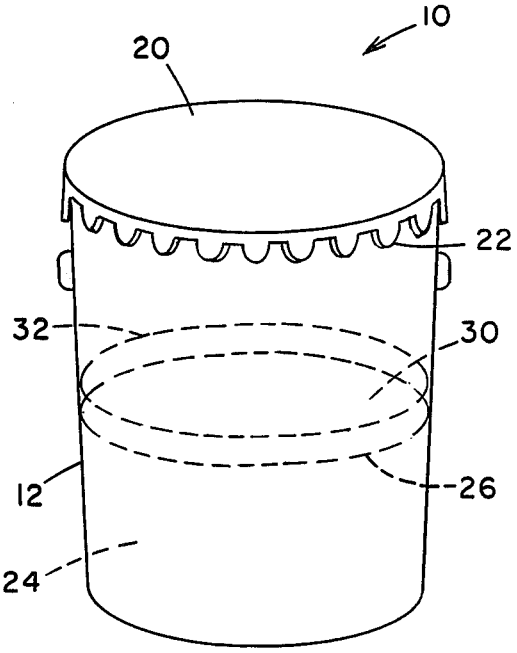
FIG. 3 is an isometric view of a resealed bucket of partially used joint compound, embodying the invention.

Referring to FIGS. 1 and 2, there is shown a five-gallon bucket 10 made of a semi-rigid plastic, consisting of a cylindrical side wall 12, a bottom wall 14, a top enlarged rim 16 and a handle 18. Also shown, removed from the bucket 10 is a top lid 20, with short bendable ribs 22, suitable for engaging rim 16 when lid 20 is placed on bucket 10.

Bucket 10 is about 95% full of an aqueous ready-mix joint compound 24, seen where a portion of bucket 10 is shown broken away. A formed-in-place seal 26 extends throughout the top surface 28 of joint compound 24 and also extends about an inch upwardly on the sidewall 12 above the joint compound 24.

Seal 26 is formed by spraying a film forming material evenly throughout the top surface 28 of the joint compound 24 and onto the sidewall 12, and then allowing the film to form into seal 26. Top 20 is then placed on bucket 10 to protect seal 26 and accordingly the Joint compound 24 thereunder.

By being formed from material sprayed on the top surface 28 and upward an inch on sidewall 12, the seal 26 is formed into a generally flat circular main portion 30 with an upwardly extending flange 32 around the periphery of main portion 30. This seal 26 insulates the joint compound from the air above it in the bucket 10.

Seal 26 is preferably polyethylene hot melt adhesive, which has been sprayed onto the top surface 28 of joint compound 24, while the polyethylene is in a heated molten condition. Seal 26 is preferably about 0.001 inch thick; however, this thickness can vary considerably, for example from about 0.0005 inch to about 0.005 inch.

The polyethylene seal 26 has sufficient integrity to be lifted off the joint compound and saved for replacement after a portion of the contents has been used.

It is not essential, in accordance with the invention, to have the seal cover the entire top surface 28 of Joint compound 24. For example, it has been found that a seal which leaves narrow areas uncovered is still very effective in preventing drying of the surface. A seal covering the center portion but leaving some portions along the edge uncovered, for widths of about one-inch, has been found to prevent any substantial drying of the one-inch wide area, as well as the covered area, which is considered to be the result of a remaining osmosis effect, with water being able to diffuse into the uncovered narrow area from portions sideward and below.

Other materials will be found to be suitable to be formed into seals, such as molten paraffin or beeswax. The seal material must not be a material which will mix with and migrate into the joint compound. The seal material may also be applied by pouring it onto the joint compound top surface 28, or by any other practical means.

Having completed a detailed disclosure of the preferred embodiments of my invention so that those skilled in the art may practice the same, I contemplate that variations may be made without departing from the essence of the invention or the scope of the appended claims.

I claim:

1. A bucket containing an aqueous slurry of drywall joint compound, said bucket of compound being of about five-gallon capacity and having a substantially impermeable, thin, flexible formed-in-place removable and reusable film seal on the top of joint compound disposed in said bucket, disposed upon and in contact with a major portion of the top surface of said slurry, wherein said seal has been formed to conform to the shape of the joint compound present in said bucket.

2. A bucket containing an aqueous slurry of drywall joint compound, said bucket of compound being of about five-gallon capacity and having a substantially impermeable, thin, flexible formed-in-place removable and reusable film seal on the top of joint compound disposed in said bucket, disposed upon and in contact with a major portion of the top surface of said slurry, wherein said seal has been formed to conform to the shape of the joint compound at a time when said bucket has a greater amount of joint compound than presently in said bucket.

3. A bucket containing an aqueous slurry of drywall joint compound, said bucket of compound being of about five-gallon capacity and having a substantially impermeable, thin, flexible formed-in-place removable and reusable film seal on the top of joint compound disposed in said bucket, disposed upon and in contact with a major portion of the top of said slurry, wherein said formed-in-place seal is made of a polyethylene hot melt adhesive.

4. The method of sealing aqueous drywall joint compound in a bucket, comprising the steps of placing a thin layer of impermeable flexible film forming material on the entire top surface of the joint compound in a bucket of about five-gallon capacity partially filled with aqueous drywall joint compound, and allowing said film forming material to form a substantially impermeable removable and reusable, flexible film, sealing said joint compound from the air in said bucket above said film.

5. The method of claim 4 wherein said thin film is placed by spraying film forming material on the top surface of the joint compound.

6. The method of claim 4 wherein said thin film is placed by applying a molten material which will solidify at normal temperature, and allowing the molten layer to solidify in place on the top surface of said joint compound.

7. The method of claim 6 wherein said thin film is a polyethylene hot melt adhesive.

* * * * *